US011551624B2

(12) United States Patent
Ishii et al.

(10) Patent No.: US 11,551,624 B2
(45) Date of Patent: Jan. 10, 2023

(54) DISPLAY DEVICE AND SOURCE DRIVER WITH LOCAL DIMMING

(71) Applicant: LAPIS Semiconductor Co., Ltd., Yokohama (JP)

(72) Inventors: Hiroaki Ishii, Yokohama (JP); Shinichi Fukuzako, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 17/319,074

(22) Filed: May 12, 2021

(65) Prior Publication Data

US 2021/0366417 A1 Nov. 25, 2021

(30) Foreign Application Priority Data

May 19, 2020 (JP) ..... JP2020-087263

(51) Int. Cl.
*G09G 3/34* (2006.01)
*G09G 3/36* (2006.01)

(52) U.S. Cl.
CPC ..... *G09G 3/3426* (2013.01); *G09G 3/3648* (2013.01); *G09G 2310/08* (2013.01); *G09G 2320/064* (2013.01); *G09G 2360/16* (2013.01)

(58) Field of Classification Search
CPC ..... G09G 3/3426; G09G 3/3648; G09G 2310/08; G09G 2320/064; G09G 2360/16
See application file for complete search history.

(56) References Cited

U.S. PATENT DOCUMENTS

2009/0267890 A1* 10/2009 Park ..... G09G 3/3426 345/102
2010/0214209 A1* 8/2010 Seo ..... G09G 3/342 345/102
2010/0277514 A1* 11/2010 Yeo ..... G09G 3/3426 345/690
2016/0035264 A1* 2/2016 Fujii ..... G09G 3/3233 345/691
2018/0231836 A1* 8/2018 Suzuki ..... G02F 1/1336

FOREIGN PATENT DOCUMENTS

JP 2005253403 A 9/2005

* cited by examiner

*Primary Examiner* — Kwang-Su Yang
(74) *Attorney, Agent, or Firm* — Rabin & Berdo, P.C.

(57) ABSTRACT

Provided is a display panel, a source driver that generates a gradation voltage signal based on an image data signal, a timing controller that supplies the image data signal to the source driver, and an illumination drive unit that controls an amount of light of a backlight that illuminates each of a plurality of areas formed by dividing a display screen in the display panel. The source driver or the timing controller calculates feature values of the image data signal corresponding to each of the plurality of areas of the display panel and supplies a dimming data signal representing the amount of light of the backlight according to the feature values of each area to the illumination drive unit. The illumination drive unit controls the amount of light of the backlight for each of the plurality of areas based on the dimming data signal.

4 Claims, 5 Drawing Sheets

| | A | B | C | D | E | F | G | H |
|---|---|---|---|---|---|---|---|---|
| 1 | GS0 | GS15 | GS20 | GS35 | GS35 | GS20 | GS15 | GS0 |
| 2 | GS15 | GS0 | GS85 | GS100 | GS100 | GS85 | GS0 | GS15 |
| 3 | GS30 | GS95 | GS185 | GS230 | GS230 | GS155 | GS95 | GS30 |
| 4 | GS30 | GS75 | GS120 | GS165 | GS165 | GS120 | GS75 | GS30 |
| 5 | GS15 | GS45 | GS60 | GS85 | GS85 | GS60 | GS45 | GS15 |
| 6 | GS0 | GS10 | GS20 | GS20 | GS20 | GS20 | GS10 | GS0 |

FIG. 4

| AVERAGE GRADATION VALUE OF AREA | AMOUNT OF DIMMING OF LED OF AREA |
|---|---|
| GS0 | 0 |
| GS1~GS15 | 1 |
| GS16~GS31 | 2 |
| GS32~GS63 | 3 |
| GS64~GS127 | 4 |
| GS128~GS191 | 5 |
| GS192~GS223 | 6 |
| GS224~GS239 | 7 |
| GS240~GS254 | 8 |
| GS255 | 9 |

FIG. 5

DISPLAY DEVICE AND SOURCE DRIVER WITH LOCAL DIMMING

CROSS-REFERENCE TO RELATED APPLICATION

This application is based upon and claims the benefit of priority from the prior Japanese Patent Application No. 2020-087263 filed on May 19, 2020, the entire contents of which are incorporated herein by reference.

BACKGROUND

1. Technical Field

The present invention relates to a display device and a source driver.

2. Description of the Related Art

There has been employed an active matrix driving method as a driving method of a display device, such as a liquid crystal display device and an organic Electro Luminescence (EL). A display apparatus with the active matrix driving method includes a display panel configured by a semiconductor substrate in which pixel portions and pixel switches are disposed in a matrix. On/off of the pixel switch is controlled by a gate pulse, and a gradation voltage signal corresponding to a video data signal is supplied to the pixel portion when the pixel switch turns on to control luminance of each pixel portion, and thus display is performed. A driving circuit of the display device includes, for example, a gate driver that outputs the gate pulse to a gate line, a source driver that outputs the gradation voltage signal to a data line, and a timing controller that supplies the source driver with image data and a timing signal.

To increase a contrast ratio between different areas in the same screen, the display device performs drive control of a backlight referred to as local dimming. As the display device performing local dimming, there has been proposed an image display device that calculates a luminance distribution of image signals, controls an illuminating light in each region based on the calculation result, and corrects the image signal (for example, see JP-A-2005-258403).

SUMMARY

The display device of the related art calculates an amount of dimming of an LED in each region in the same screen with reference to image data and corrects luminance of the image data according to the amount of dimming. This allows minute local dimming in a display device including a large screen or the like.

However, to correct the luminance of the image data according to the amount of dimming of the LED, in addition to a TCON and a driver, an IC and a Field Programmable Gate Array (FPGA) dedicated for local dimming are required. Accordingly the configuration of the related art has caused problems of increasing device scale and rising cost for the display device which is required to have a small device scale, such as an on-board display device.

The present invention has been made in consideration of the problems and an object of the present invention is to provide a display device that allows performing local dimming while reducing a device scale.

A display device according to the present invention is a display device comprising: a display panel that includes a plurality of source lines and a plurality of gate lines, and a plurality of pixel switches and pixel portions disposed at respective intersecting portions of the plurality of source lines and the plurality of gate lines in a matrix; a gate driver that supplies gate signals to control the pixel switches so as to be on in a selection period according to a pulse width to the plurality of gate lines; a source driver that receives the image data signal and generates a gradation voltage signal for each of the plurality of pixel portions as a supply target based on the image data signal; a timing controller that supplies the image data signal to the source driver; and an illumination drive unit that controls an amount of light of a backlight that illuminates each of a plurality of areas formed by dividing a display screen in the display panel, wherein the source driver or the timing controller includes a local dimming function unit that generates a dimming data signal representing the amount of light of the backlight corresponding to each of the plurality of areas of the display panel based on the image data signal, and the illumination drive unit controls the amount of light of the backlight for each of the plurality of areas based on the dimming data signal.

A source driver according to the present invention is A source driver coupled to a display panel and an illumination drive unit, wherein the display panel includes a plurality of pixel portions disposed in a matrix, the illumination drive unit controls an amount of light of a backlight, the backlight illuminates each of a plurality of areas formed by dividing a display screen in the display panel, wherein the source driver generates a gradation voltage signal for each of the plurality of pixel portions as a supply target based on an image data signal, wherein the source driver includes a local dimming function unit that receives the image data signal, calculates feature values of the image data signal corresponding to each of the plurality of areas of the display panel, and supplies a dimming data signal representing the amount of light of the backlight according to the feature values of each area to the illumination drive unit.

The display device of the present invention allows performing local dimming while reducing a device scale.

BRIEF DESCRIPTION OF THE DRAWINGS

Features of the present invention will be described below with reference to the accompanying drawings.

FIG. 4 is a diagram schematically illustrating average gradation values of a plurality of respective areas in a display screen; and FIG. 5 is a diagram illustrating an example of a conversion table of the average gradation values and amounts of dimming.

DETAILED DESCRIPTION

Figure 1:
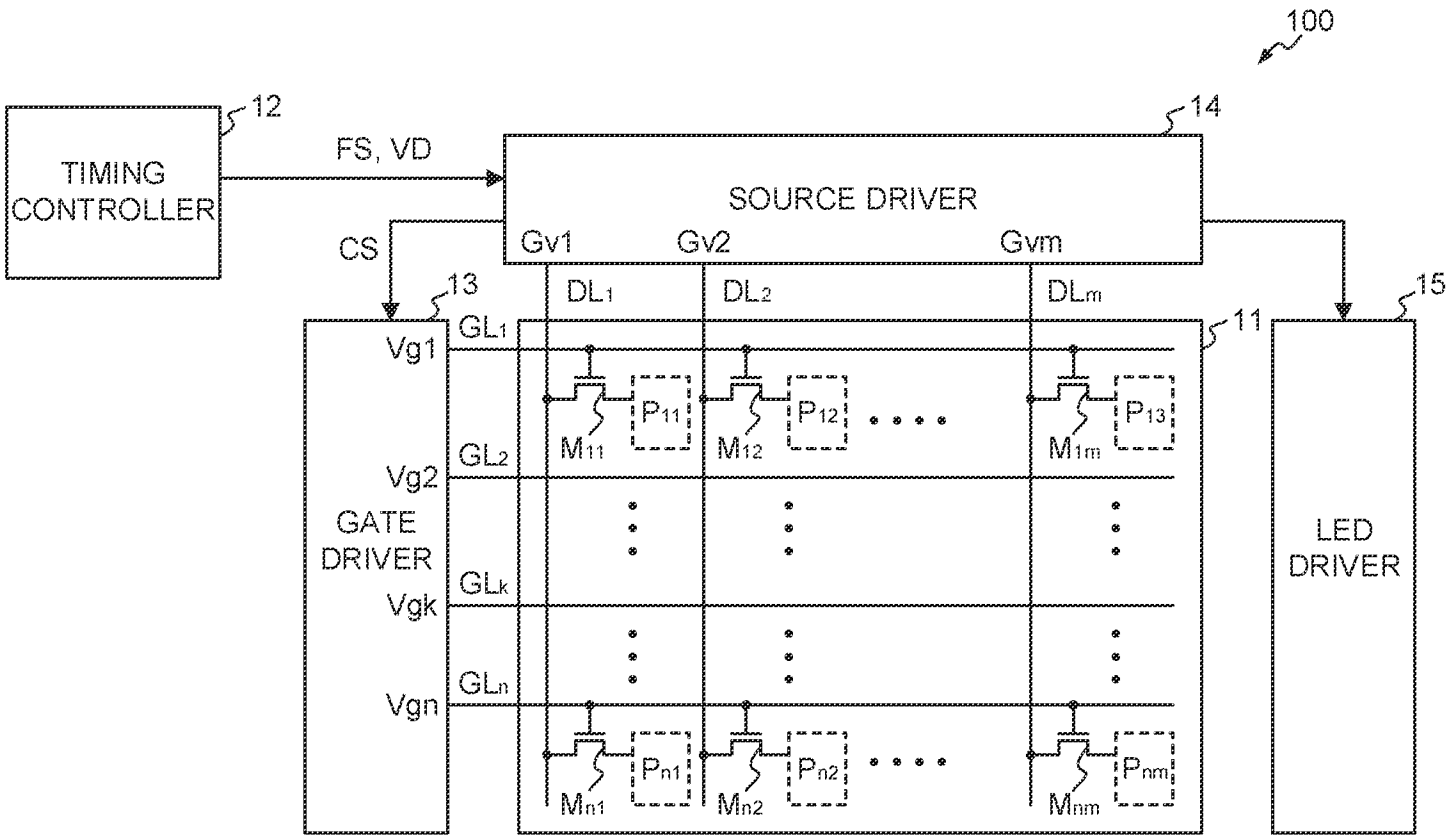
FIG. 1 is a block diagram illustrating a configuration of a display device according to the present invention.

Preferred embodiments of the present invention will be described in detail below. Note that the same reference numerals are given to substantially identical or equivalent parts in the description in the following respective embodiments and the accompanying drawings.

Embodiment 1

FIG. 1 is a block diagram illustrating a configuration of a display device 100 according to the present invention. The display device 100 is a liquid crystal display device in an active matrix driving method. The display device 100 includes a display panel 11, a timing controller 12, a gate driver 13, a source driver 14, and an LED driver 15.

The display panel 11 is configured of a semiconductor substrate in which a plurality of pixel portions P11 to Pnm and pixel switches M11 to Mnm (n is an integer of 2 or more, and m is an integer of 2 or more and a multiple of 3) are arranged in a matrix of n rows×m columns. The display panel 11 includes n gate lines GL1 to GLn as horizontal scanning lines and m data lines DL1 to DLm arranged to perpendicularly intersect therewith. The pixel portions P11 to Pnm and the pixel switches M11 to Mnm are disposed at intersecting portions between the gate lines GL1 to GLn and the data lines DL1 to DLm and are arranged in a matrix.

The pixel switches M11 to Mnm are controlled to be turned on or off according to gate signals Vg1 to Vgn supplied from the gate driver 13. The pixel portions P11 to Pnm receive supplies of gradation voltage signals Gv1 to Gvm corresponding to video data from the source driver 14. When the respective pixel switches M11 to Mnm are on, the gradation voltage signals Gv1 to Gvm are applied to the respective pixel electrodes of the pixel portions P11 to Pnm to charge the respective pixel electrodes. According to the gradation voltage signals Gv1 to Gvm applied to the respective pixel electrodes of the pixel portions P11 to Pnm, luminance of the pixel portions P11 to Pnm are controlled, and thus display is performed.

In other words, by the operation of the gate driver 13, the m pixel portions arranged along the extension direction of the gate line (namely, arranged in one horizontal row) are selected as supply targets of the gradation voltage signals Gv1 to Gvm. The source driver 14 applies the gradation voltage signals Gv1 to Gvm to the selected pixel portions in one horizontal row to display colors according to the voltages. By repeating these operations while selectively switching the target the pixel portions by one horizontal row as the supply targets of the gradation voltage signals Gv1 to Gvm, one frame of screen is displayed.

Each of the pixel portions P11 to Pnm includes a transparent electrode coupled to the data line via the pixel switch and a liquid crystal enclosed between the transparent electrode and a counter substrate. The counter substrate is provided to be opposed to the semiconductor substrate and includes one transparent electrode formed on the whole surface. Displaying is accomplished by changes in transmittance of the liquid crystal with respect to a backlight inside the display device, according to voltage differences between the gradation voltage signals Gv1 to Gvm supplied to the pixel portions P11 to Pnm and a counter substrate voltage.

The timing controller 12 supplies an image data signal VD to the source driver 14. The image data signals VD are serialized data signals formed of a series of pixel data pieces PD that represent luminance levels of the respective pixels by 256-level luminance gradations in 8 bits, for example. The timing controller 12 supplies a frame synchronization signal FS to the source driver 14.

The gate driver 13 receives gate control signals CS from the source driver 14. The gate driver 13 sequentially supplies the gate signals Vg1 to Vgn to the gate lines GL1 to GLn based on clock timings included in the gate control signals CS.

The frame synchronization signals FS and the image data signals VD are supplied from the timing controller 12 to the source driver 14. The source driver 14 generates the gradation voltage signals Gv1 to Gvm according to the image data signals VD and supplies them to the pixel portions P11 to Pnm via the data lines DL1 to DLm. The source driver 14 supplies the gradation voltage signals Gv1 to Gvm in multi-valued level according to the number of gradations to the data lines DL1 to DLm.

Additionally, the source driver 14 generates the gate control signal CS based on the frame synchronization signal FS and supplies it to the gate driver 13.

The LED driver 15 is an illumination drive unit that drives an illumination unit (not illustrated in FIG. 1) constituted of a Light Emitting Diode (an LED) to control an amount of light of the backlight that illuminates the display panel 11. The illumination unit is constituted of a plurality of light sources. The LED driver 15 allows controlling luminance of the backlight in each area of a plurality of the areas, which are formed by dividing the display panel 11, by controlling a light emission of each light source. The LED driver 15 is coupled to the source driver 14 so as to receive a supply of a dimming data signal from the source driver 14. The LED driver 15 controls the luminance of the backlight by driving the plurality of light sources of the illumination unit according to the dimming data signals.

Figure 2:
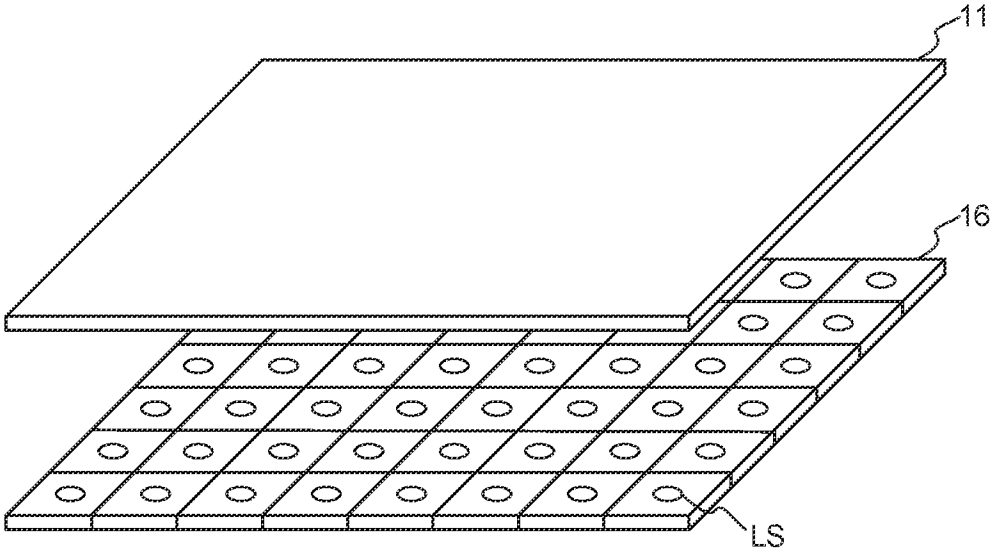
FIG. 2 is a diagram schematically illustrating a positional relationship between a display panel and an illumination unit.

FIG. 2 is a diagram schematically illustrating a positional relationship between the display panel 11 and an illumination unit 16. The illumination unit 16 is constituted of a plurality of light sources LS disposed corresponding to the respective areas, which are formed by dividing the display screen of the display panel 11 into the plurality of areas. Each of the plurality of light sources LS is constituted of an emitter formed of, for example, an LED. Emission luminance of each of the plurality of light sources LS is separately controlled by the LED driver 15, and the luminance can be switched in a plurality of levels.

With reference to FIG. 1 again, the source driver 14 has a simple local dimming function that performs contrast adjustment of the display screen according to the image data signals VD.

Figure 3:
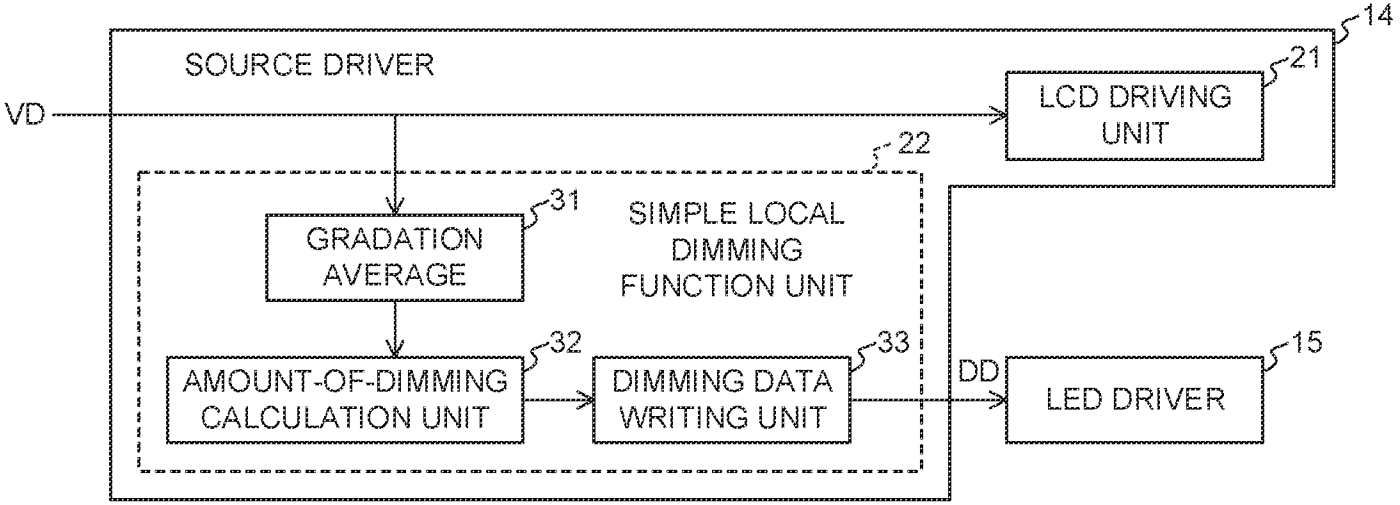
FIG. 3 is a block diagram illustrating a configuration of a source driver.

FIG. 3 is a block diagram illustrating the configuration of the source driver 14. The source driver 14 includes a Liquid Crystal Display (LCD) driving unit 21 and a simple local dimming function unit 22.

The LCD driving unit 21 is a liquid crystal display driving unit that receives the supply of the image data signals VD and supplies the gradation voltage signals Gv1 to Gvm according to the image data signals VD to the data lines DL1 to DLm to drive the display panel 11. For example, the LCD driving unit 21 includes a data latch unit that sequentially retrieves the pixel data pieces PD from the image data signals VD, a gradation voltage converter (not illustrated) that converts the pixel data pieces PD into the gradation voltage signals Gv1 to Gvm, and the like.

The simple local dimming function unit 22 generates a dimming data signal DD to control the amount of light of the backlight that irradiates the display panel 11 and supplies it to the LED driver 15. The simple local dimming function unit 22 includes an average gradation calculation unit 31, an amount-of-dimming calculation unit 32, and a dimming data writing unit 33.

The average gradation calculation unit 31 obtains the gradations (GS) of the pixels in each display area when the image data by one frame is displayed in the display panel 11 as feature values based on the image data signal VD and calculates the average value. For example, the average gradation calculation unit 31 calculates the average value of the gradations of the respective areas in a case where the display screen of the display panel 11 is divided into the plurality of areas.

FIG. 4 is a diagram schematically illustrating the display screen of the display panel 11 divided into the plurality of areas and the average values of the gradations of the respective areas. Here, the average gradation values of the respective areas, which are formed by dividing the display screen into 8 columns (A to H)×6 rows (1 to 6), are represented by 256 gradations from GS0 to GS255. In this embodiment, each of the plurality of areas illustrated in FIG. 4 corresponds to irradiation region of the backlight by each of the plurality of light sources LS illustrated in FIG. 2.

For example, in a case where the image data signal VD in which the background is dark and an object relatively brighter than the background is present at the center of the screen is supplied, the average gradation values are distributed as illustrated in FIG. 4. That is, the comparatively high gradations are calculated as the average gradation values in the areas positioned at the center of the display screen (for example, D3 and E3), and the comparatively low gradations are calculated as the average gradation values in the areas positioned at the peripheral edge portion (for example, from A1 to A6).

The amount-of-dimming calculation unit 32 calculates the amount of dimming for each area to control the light emission of the backlight based on the average gradation value of each area calculated by the average gradation calculation unit 31. The amount-of-dimming calculation unit 32 calculates the amount of dimming in 10 levels, the amounts of dimming of from 0 to 9. The amount-of-dimming calculation unit 32 converts the average gradation value into the amount of dimming, for example by using a conversion table, so as to calculate the amount of dimming.

FIG. 5 is a diagram illustrating an example of the conversion table to calculate the amount of dimming based on the average gradation value. For example, the average gradation value GS0 becomes the dimming amount 0, the average gradation values GS1 to 15 become the dimming amount 1, . . . , the average gradation values GS240 to 254 become the dimming amount 8, and the average gradation value GS255 becomes the dimming amount 9.

The dimming data writing unit 33 generates the dimming data signal DD to set the amount of light of the backlight by the light source LS corresponding to each area based on the amount of dimming of each area calculated by the amount-of-dimming calculation unit 32, and outputs the dimming data signal DD to the LED driver 15.

The LED driver 15 controls the light emission of the plurality of light sources LS in the illumination unit 16 based on the dimming data signal DD, such that the irradiation of the backlight is performed at the amount of dimming corresponding to each area. For example, the LED driver 15 switches the emission luminance of the respective plurality of light sources LS in 10 levels based on the dimming data signals DD. Thus, the amount of light of the backlight is adjusted according to the gradations of the image data signal VD of each area in the display screen by one frame, thereby ensuring obtaining an appropriate contrast ratio according to the display image.

As described above, in the display device 100 of this embodiment, the simple local dimming function unit 22, which is disposed in the source driver 14, calculates the amount of dimming from the average gradation value of each of the plurality of areas formed by dividing the display panel 11 based on the image data signal VD. Then, the local dimming is performed by controlling the LED driver 15 based on the calculated amounts of dimming. This configuration allows reducing the scale of the entire device compared with a case where IC, FPGA, and the like dedicated for local dimming are disposed.

That is, to perform minute local dimming involving the correction of image data, the IC dedicated for local dimming or the like needs to be disposed, resulting in an increase in the scale of the entire device. In contrast to this, the local dimming performed in this embodiment is simple local dimming not involving the correction of image data according to the amount of dimming, so that it is not necessary to provide the dedicated IC or the like. Mounting the simple local dimming function to the source driver 14 as in this embodiment allows to reduce the device scale while sufficiently achieving the appropriate contrast according to image data. It is useful especially for a small-sized display device such as a device mounted on vehicle.

Note that the present invention is not limited to ones described in the embodiments. For example, the case where the simple local dimming function unit 22 is disposed in the source driver 14 has been described as an example in the embodiment. However, different from this, the timing controller 12 may include a function unit equivalent to the simple local dimming function unit 22. This configuration also allows performing local dimming while the device scale is reduced.

The embodiment has described the example in which the light sources are disposed for the respective areas formed by dividing the display screen of the display panel 11 into the areas of 8 columns×6 rows, the average gradation values of the image data signals of the respective areas are obtained, and the amounts of dimming are calculated based on the average gradation values so as to control the LED driver. However, the division of the areas of the display screen in the display panel 11 is not limited to this. For example, the display screen may be divided into areas greater than 8 columns×6 rows.

Additionally, to calculate the amount of dimming of each area, the amount of dimming is calculated not only using the average gradation value of the corresponding area, but the amount of dimming of each area may be calculated with reference to the average gradation values of the adjacent areas in addition to this.

The example, in which the average value of the gradations of the pixels of each area when the image is displayed in the display panel is calculated based on the image data signal, and the amount of dimming is calculated using the calculated average value of the gradations, has been described in the embodiment. However, the embodiment is not limited to this, and the amount of dimming may be calculated using another calculation method other than the average of the gradation. Additionally, an element other than the gradation may be calculated as feature values, and the amount of dimming may be calculated based on the calculated feature values. That is, it is only necessary that the feature values of the image data signal corresponding to each area is calculated based on the image data signal VD, a predetermined calculation is performed based on the calculated feature values, and the amount of dimming of each area is calculated.

What is claimed is:

1. A display device comprising:

a display panel that includes a plurality of source lines and a plurality of gate lines, and a plurality of pixel switches and pixel portions disposed at respective intersecting portions of the plurality of source lines and the plurality of gate lines in a matrix;

a gate driver that supplies gate signals to control the pixel switches so as to be on in a selection period according to a pulse width to the plurality of gate lines;

a source driver that includes a display drive unit that receives an image data signal and generates a gradation voltage signal for each of the plurality of pixel portions as a supply target based on the image data signal;

a timing controller that supplies the image data signal to the source driver; and an illumination drive unit that controls an amount of light of a backlight that illuminates each of a plurality of areas formed by dividing a display screen in the display panel, wherein:

the source driver further includes a local dimming part that generates a dimming data signal representing the amount of light of the backlight corresponding to each of the plurality of areas of the display panel based on the image data signal;

the local dimming part includes a first calculation unit that calculates an average value of gradations of the image data signal, the gradations respectively corresponding to the plurality of areas, a second calculation unit that calculates an amount of dimming of the backlight for each of the plurality of areas based on the average value of the gradations for each area, and a dimming data writing unit that generates the dimming data signal based on the amount of dimming for each area; and the illumination drive unit controls the amount of light of the backlight that illuminates each of the plurality of areas based on the dimming data signal.

2. The display device according to claim 1, wherein the local dimming part calculates the average value of the gradations for each of the plurality of areas based on the gradations of the image data signal respectively corresponding to the plurality of areas and a gradation of the image data signal corresponding to an area adjacent to at least one of the plurality of areas.

3. An apparatus comprising:

a source driver coupled to a display panel and an illumination drive unit, wherein the display panel includes a plurality of pixel portions disposed in a matrix, the illumination drive unit controls an amount of light of a backlight, and the backlight illuminates each of a plurality of areas formed by dividing a display screen in the display panel, wherein the source driver includes a display drive unit that generates a gradation voltage signal for each of the plurality of pixel portions as a supply target based on an image data signal, and wherein:

the source driver further includes a local dimming part that generates a dimming data signal representing the amount of light of the backlight corresponding to each of the plurality of areas of the display panel based on the image data signal; and the local dimming part includes a first calculation unit that calculates an average value of gradations of the image data signal, the gradations respectively corresponding to the plurality of areas, a second calculation unit that calculates an amount of dimming of the backlight for each of the plurality of areas based on the average value of the gradations for each area, and a dimming data writing unit that generates the dimming data signal based on the amount of dimming for each area.

4. The apparatus according to claim 3, wherein the local dimming part calculates the average value of the gradations for each of the plurality of areas based on the gradations of the image data signal respectively corresponding to the plurality of areas and a gradation of the image data signal corresponding to an area adjacent to at least one of the plurality of areas.

* * * * *